US005114022A

United States Patent [19]

Rood

[11] Patent Number: 5,114,022

[45] Date of Patent: May 19, 1992

[54] HOUSE PLANT DISPLAY STRUCTURE

[76] Inventor: Terry M. Rood, P.O. Box 252, Montague, Calif. 96064

[21] Appl. No.: 598,204

[22] Filed: Oct. 16, 1990

[51] Int. Cl.[5] ..... A47G 29/00

[52] U.S. Cl. ..... 211/71; 108/92; 211/128; 211/189; 248/146

[58] Field of Search ..... 248/121, 146, 27.8; 211/189, 71, 128, 135, 133, 134; 108/92, 95

[56] References Cited

U.S. PATENT DOCUMENTS

| | | | |
|---|---|---|---|
| 409,642 | 8/1889 | Little | 211/134 X |
| 1,429,587 | 9/1922 | Harris | 211/71 X |
| 1,954,601 | 4/1934 | Sowerwine | 108/92 |
| 2,009,741 | 7/1935 | Mentges | 211/134 X |
| 2,050,638 | 8/1936 | Tuthill | 248/125 |
| 2,103,127 | 12/1937 | Enkevoort | 211/71 |
| 3,230,907 | 1/1966 | Morford et al. | 108/92 X |
| 4,121,377 | 10/1978 | Allen et al. | 108/92 X |
| 4,188,891 | 2/1980 | Boyajian | 108/92 X |
| 4,463,855 | 8/1984 | Smithers | 211/71 |
| 4,550,838 | 11/1985 | Nathan et al. | 211/128 |

FOREIGN PATENT DOCUMENTS

| | | | |
|---|---|---|---|
| 2824029 | 12/1979 | Fed. Rep. of Germany | 211/189 |
| 7104141 | 9/1971 | Netherlands | 248/146 |

*Primary Examiner*—David L. Talbott
*Attorney, Agent, or Firm*—Richard C. Litman

[57] ABSTRACT

Modular shelving for window displays comprises angled beams, at 45 degrees to the horizontal, and small horizontal shelves set on the beams. The shelves are to hold individual plants or the like. The beam ends are cut at 45 degrees, the cuts either parallel or at right angles to each other on a beam. The ends are adapted to be joined by dowels at either right or straight angles. Thus the beams may be combined in various plane configurations to form a diamond shape, W-shape, X-shape, zigzag, and so on; the plants or items may then be arranged upon the small shelves on the beams in similar figures for window display. The weight of the structures is borne by support poles with feet. The support poles are of two lengths, the shorter being half the length of the longer; the shorter poles have a length equal to one half of the beam length, divided by the square root of two. The longer are double that length. Having these lengths, the poles are thereby adapted to support the various configurations of the beams; for example, the short beam will support, at the midpoint of one inclined beam having an end resting on the floor, the weight of that beam.

11 Claims, 2 Drawing Sheets

HOUSE PLANT DISPLAY STRUCTURE

FIELD OF THE INVENTION

The present invention relates to modular shelving which can be assembled in various configurations. The invention is intended for displaying house plants.

DESCRIPTION OF THE PRIOR ART

Shelving is ancient. More recent is shelving with movable shelves, or modular shelves. Various systems of such shelving are known in the art.

One example is shelving supported by metal brackets which hook inot slots on vertical metal channels fastened to a wall. The shelves may be positioned at will at various heights. Many similar systems are known.

Palmenberg, in U.S. Pat. No. 108,046 shows shelves mounted by special hardware on a pair of rods angled to the horizontal. The angle is variable.

Wegener, in U.S. Pat. No. 442,468, discloses a plurality of shelf supports mounted to a single member.

Lemon, in U.S. Pat. No. 584,057, shows individual shelves for holding a single flower pot. Each shelf is supported by a bracket on an angled beam.

Boone, in U.S. Pat. No. 1,137,737, shows a plant stand with curved shelves supportred by brackets on beams which radiate from a center.

Calkins, in U.S. Pat. No. 1,827,969, shows a display rack comprising an angled surface with slots, the slots arranged in rows and columns. Individual shelves each have a member extending from the rear of the shelf; the members are insertable into the slots to support the shelves.

Keller, in U.S. Pat. No. 1,964,124, teaches a frame of three bars connected at their ends; horizontal, vertical, and hypotenuse bars. Individual shelves are mounted to the angled hypotenuse bar, which has holes drilled sideways therethrough for mounting the shelves.

Erickson, in U.S. Pat. No. 3,906,872, discloses shelves to fit into a corner. The shelves are supported by three square section rods: one in the corner, and two angled rods along the walls on either side. The rods are fastened by dowels fixed in matching holes in either rods. The angled rod ends are beveled so that their ends lie flat on the sides of the upright rod.

Allen, et al, in U.S. Pat. No. 4,121,377, show a plant display bench with shelves held between angled beams on either side. The Allen structure can be assembled in various configurations.

None of the above inventions and patents, taken either singly or in combination, is seen to describe the instant invention as claimed.

In particular, none of the above inventions is seen to allow staggering of items such as plants on adjacent shelves of unequal height, the shelves beingon beams all lying in a single plane. The arrangement in a plane is suited to window displays.

Accordingly, one object of the present invention is shelving which is suitable for displaying house plants in a window.

A further object of the present invention is shelving which presents items to a viewer on staggered shelves, the items arranged along lines inclined to the horizontal, the lines lying in a plane for window display.

Another object of the present invention is shelving which is attractive in appearance.

Still another object of the present invention is shelving which is modular, having pieces which can be combined in various ways for variety and to fit various spaces.

A final object of the present invention is shelving which easily disassembles and stores in a small volume.

These and other objects of the present invention will become readily apparent upon further review of the following specification and drawings.

SUMMARY OF THE INVENTION

The present invention is a system of modular shelving for window displays, especially plant displays. The system basically comprises a number of angled wooden beams, each set at 45 degrees to the horizontal, and small horizontal shelves set on the beams for holding the plants.

The beam ends are cut at 45 degrees; the cuts are either parallel, or at right angles to each other. Thus there are two types of beam. The beams ends are adapted to be joined by dowels at either right or straight angles. Because of the two ways of joining the beam ends, and the two types of beam, the beams may be combined in various plane configurations to form a diamond shape, W-shape, X-shape, zig-zag, and so on. The plants (or other items) may then be arranged upon the small shelves on the beams in similar figures for attractive window display.

The weight of the structures is borne by support poles with feet. The support poles are of two lengths, the shorter being half the length of the longer. The shorter poles have a length equal to one half of the beam length, divided by the square root of two; the longer poles are double this length.

The poles are adapted, with these lengths, to support the various configurations of the beams; for example, the short beam will support, at the midpoint of one inclined beam having an end resting on the floor, the weight of that beam.

The entire structure is preferably made of wood and fastened with dowels friction-fit to mating holes in the various pieces.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
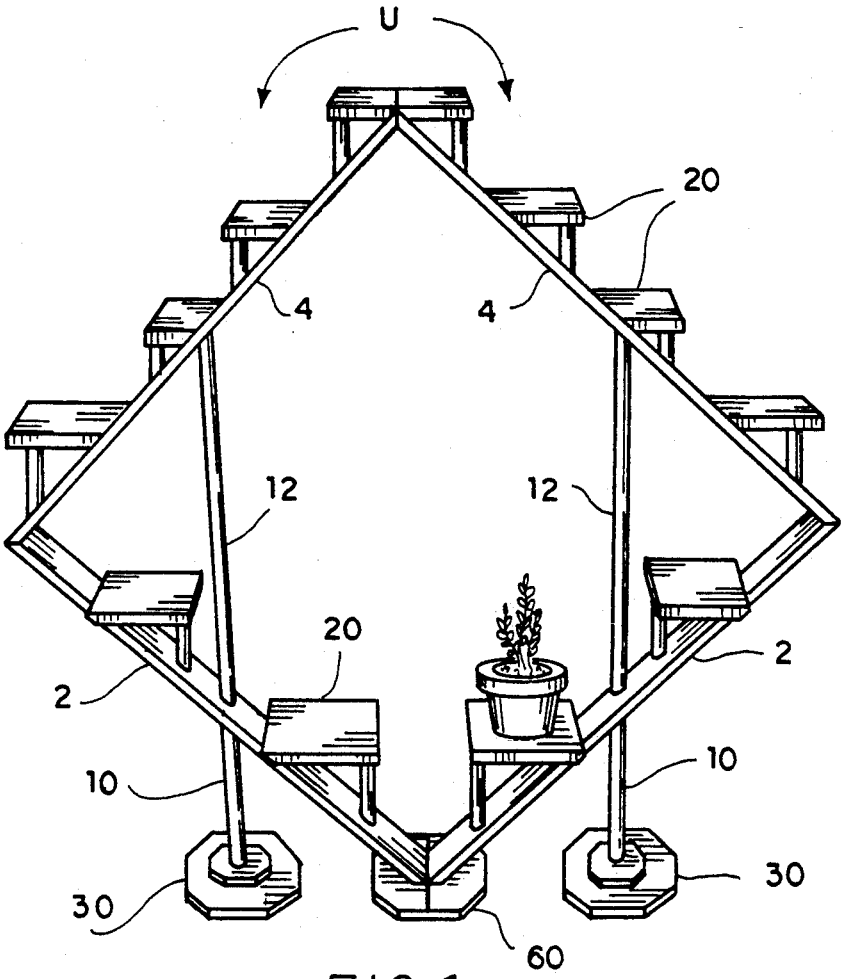
FIG. 1 is a perspective view of beams, shelves, support poles, and feet assembled into one configuration, a diamond shape.

The present invention is shown in FIG. 1. The shelf system is shown in a diamond-shaped configuration. It comprises a pair of units U, joined along a central line symmetry.

Figure 4A:
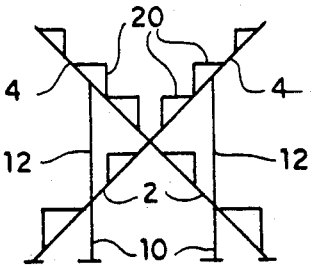
FIGS. 4A and 4B comprise schematic views of various configurations of beams and shelves.
Figure 4B:
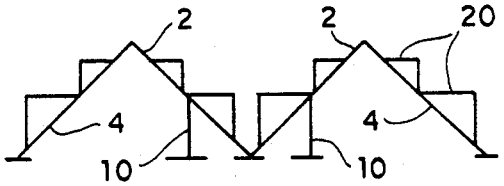

Each unit is composed of two beams 2, 4, supported by poles 10, 12, and surmounted by shelves 20. The parts are preferably made of wood. Wooden dowels hold the parts together so that the display structure can be disassembled and stored in a small space, and also put together in various configurations as shown in FIGS. 4A and 4B.

The lower beam 2 and the upper beam 4 are the basic parts adapted to be fit together in various configurations. The ends of these beams are defined by plane cuts which are angled at 45 degrees to the wider plane surfaces of the beam, as shown in greater detail in FIG. 2. These angled plane cuts are at right angles to each other in the case of the upper beam 4, and are parallel in the case of the lower beam 2, as shown in FIG. 1.

Figure 2:
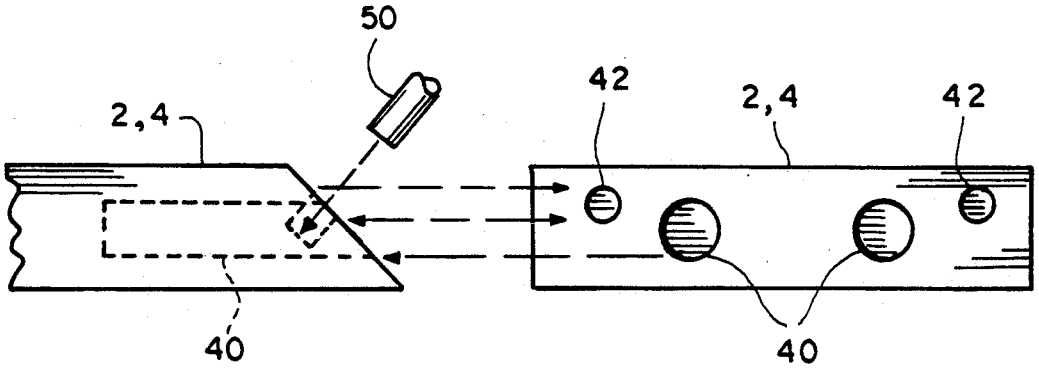
FIG. 2 shows beam end dowels and holes for attachment of one beam end to another.
Figure 3:
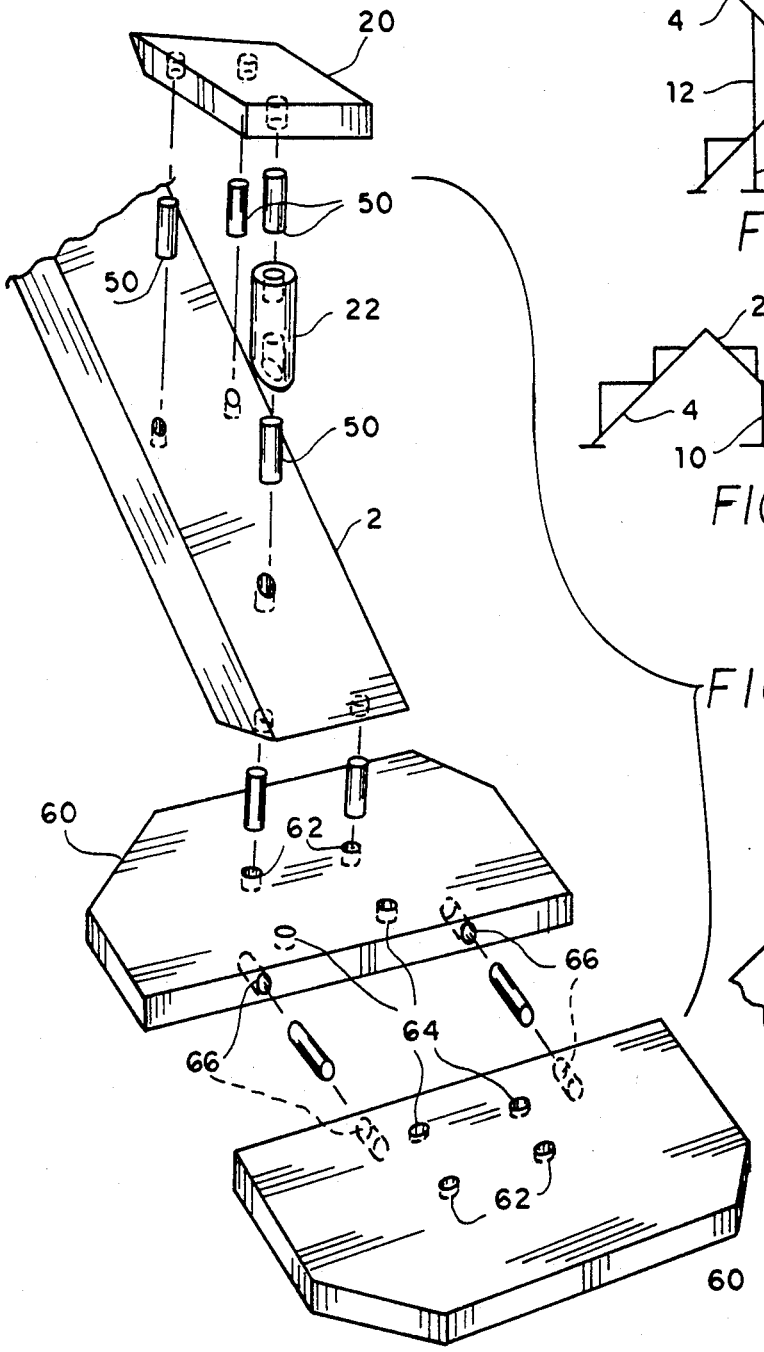
FIG. 3 is an exploded schematic view of a beam end with a shelf thereupon, a pair of feet, and connecting dowels.

All of the ends of these beams 2, 4 are drilled with blind holes as shown in FIG. 2. One pair of holes 40 is drilled parallel to the length of th beam. These are used with friction-fit dowels to attach another beam which continues in the line of the first beam. (One dowel 50 aligned to another hole is shown in FIG. 2. Connecting dowels are also shown in FIG. 3.)

The dowels are in length approximately equal to (but of necessity strictly less than) half the depth of the blind holes 40. If the dowel is longer than the sum of the depths of the holes 40 in the two beams, the beams will not meet.

The other pair of holes 42 is drilled perpendicular to the surface of the end cut, and at 45 degrees to the beam surface. This pair of holes is used with dowels, smaller than those fitting holes 40, to join the beam ends so that the beams are at right angles.

The beams 2, 4, which support the shelves 20 and the plants or other things on the shelves, must be supported against the force of gravity. The support poles 10, 12 fulfill this function. They are preferably large diameter round wooden dowels.

The lower end of the short pole 10 is cut off at right angles to the length of the pole. The upper end is cut at 45 degrees. The longer pole 12 has ends both cut off a 45 degrees. As with the one sort of beam 4, the planes of the cuts are at right angles to one other.

The short pole 10 is half the length of the long pole 12, as measured from end to end along a line down the center of either pole.

The short pole's length is such that it will support the middle of a beam which is angled at 45 degrees to the horizontal. In this situation a right triangle is formed by the beam, the upright pole and the horizontal floor. By the theorem of Pythagoras, the length of the pole is then equal to half the beam length divided by the square root of two.

The beams are fixed to the poles as they are to one another, with dowels. Each beam has angled blind dowel holes at its midpoint, and each pole has similar holes drilled along its axis. The dowels are vertical when the shelf system is set up.

The lower end of the short pole 10 rests upon a base 30, which has a dowel hole for locating the pole to the center of the base. The base in preferably wooden, composed of two joined layers, each octagonal in shape. Each layer may have routed edges for a pleasing appearance.

If the shelf system is found to be unstable, the base 30 may be provided with stabilizer rods in grooves or slots on its bottom, which can be extended and locked to widen the effective base and to provide stability. The locking may be done with small plates bearing on the stabilizer rods.

In the diamond-shaped configuration shown in FIG. 1, the long pole may support an upper beam set at a right angle to a lower beam, which is set a 45 degrees to the floor.

Because of the two ways in which the beams can be joined, there are many configurations possible with a pair of units. Two of these configurations are shown schematically in FIGS. 4A and 4B. In another configuration (not shown FIG. 4) two beams are joined at their ends to form a straight line, and the two poles are placed end to end to support the midpoint of the upper beam.

Referring to FIG. 3, a shelf 20 is shown exploded from the top surface of a beam 2. All of the individual shelves are fixed to the beams by dowels 50. Each shelf has a shelf support pole 22 having an upper end cut at 90 degrees which supports the shelf, and a lower end cut at 45 degrees, which rests upon the beam.

The lower end of a beam may rest upon a foot 60, which has generally the shape of half of a base (a base sawn down the middle). The foot has holes which are placed to match the holes in the beam ends, discussed above.

There are four holes in each foot. One pair of holes 62 is toward the center of the foot, and the other parir 64 is closer to the edge. The center pair 62 is used in some configurations. The edge pair 64 is used when two beam ends come together near the floor as in the case in the diamond-shaped configuration of FIG. 1. In this case each beam is doweld to one foot by dowels 52, and the two feet are doweled together by dowels 54 fitting into holes 66. The result is two beam ends abutting on a base-like structure similar in appearance to a base 30.

Figure 5:
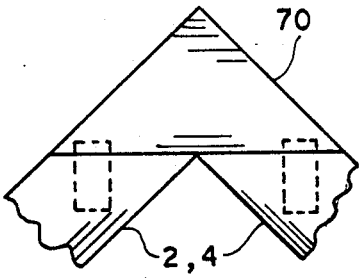
FIG. 5 shows a connecting piece used for joining beam ends in certain beam configurations.

In certain configurations an auxilaiary connecting piece 70, shown in FIG. 5, is useful. This piece is a triangular prism of wood adapted to be connected to two adjacent beams ends 2, 4 when the angled faces of the beam ends do not meet, as will happen in certain configurations, wherein the adjacent ends are coplanar but non-mating; that is, where the one end surface is a continuation, rather than a superposition, of the other.

It is to be understood that the present invention is not limited to the sole embodiment described above, but encompasses any and all embodiments within the scope of the following claims.

I claim:

1. A shelf system unit comprising in combination:

a top beam having a top beam upper surface, a top beam lower surface, a top beam upper midpoint on said top beam upper surface, a top beam lower midpoint on said top beam lower surface, a top beam lower end, and a top beam upper end, said top beam disposed at an oblique angle above the horizontal;

a bottom beam, generally equal in dimensions to said top beam, having a bottom beam upper surface, a bottom beam lower surface, a bottom beam upper midpoint on said bottom beam upper surface, a bottom beam upper midpoint on said bottom beam lower surface, a bottom beam lower end, and a bottom beam upper end, said bottom beam disposed at said oblique angle below the horizontal;

a vertical short pole having a short pole upper end and a short pole lower end;

a vertical long pole having a long pole upper end and a long pole lower end, said long pole being twice the length of said short pole;

shelves mountable upon said top beam upper surface and upon said bottom beam upper surface, said shelves including horizontal support surfaces;

first means for selectively attaching said top beam lower end to said bottom beam upper end in a first configuration, said top beam and said bottom beam lying in a vertical plane when attached and forming a doubled angle therebetween, said doubled angle twice said oblique angle;

means for attaching said short pole upper end to said bottom beam lower midpoint in said first configuration;

means for attaching said long pole lower end to said bottom beam upper midpoint in said first configuration;

means for attaching said long pole upper end to said top beam lower midpoint in said first configuration; whereby the beams may be arranged selectively in a broken line in said first configuration with said bottom beams supported by said short pole between said bottom beam lower midpoint and a floor, with said top beam supported by said long pole between said bottom beam upper midpoint and said top beam lower midpoint, and objects may be supported on said shelves at various places along said beams.

2. The unit according to claim 1 including a base between said lower end of said short pole and the floor; and at least one foot between the floor and said bottom beam lower end.

3. The unit according to claim 1, including a plurality of said units, means for attaching one said upper end of one said top beam to another one said upper end of another top beam, and means for attaching one said lower end of one said bottom beam to another one said lower end of another bottom beam; whereby the beams may be variously arranged.

4. The plurality of units according to claim 3, including at least one connection piece attachable to adjacent ends of said beams when said adjacent ends do not mate.

5. The plurality of units according to claim 4 including a base between each said lower end of said short pole and the floor; and feet between the floor and respective said bottom beam lower ends, each one of said feet adapted to mate to another one of said feet when the respective bottom beam lower ends are adjacent.

6. The unit according to claim 1 wherein said upper end of said top beam defines a vertical plane, said lower end of said top beam defines a horizontal plane, said upper end of said bottom beam defines a horizontal plane, and said lower end of said bottom beam defines a horizontal plane.

7. The unit according to claim 6 wherein:

said short pole lower end includes a short pole lower end surface at right angles to the axis of said short pole;

said short pole upper end includes a short pole upper end upper surface at 45 degrees to the axis of said short pole;

said long pole lower end includes a long pole lower end surface at 45 degrees to the axis of said long pole; and said long pole upper end includes a long pole upper end surface at right angles to said long pole lower end surface.

8. The unit according to claim 7 wherein said unit is made of wood.

9. The unit according to claim 8 wherein first means for attaching said top beam lower end to said bottom beam upper end, said means for attaching said short pole upper end to said bottom beam lower midpoint, said means for attaching said long pole lower end to said bottom beam upper midpoint, said means for attaching said long pole upper end to said top beam lower midpoint, said second means for attaching said top beam lower end to said bottom beam upper end, and said means for attaching said short pole upper end to said long pole lower end include dowels.

10. The unit according to claim 1 wherein said oblique angle is 45 degrees.

11. The unit according to claim 1 wherein said unit is permanently assembled in said first configuration.

* * * * *